US011690426B2

(12) United States Patent
Horewitch

(10) Patent No.: US 11,690,426 B2
(45) Date of Patent: Jul. 4, 2023

(54) EASY REMOVAL PREVENTION FOOTWEAR APPARATUS

(71) Applicant: Sharyn Horewitch, Cornelius, NC (US)

(72) Inventor: Sharyn Horewitch, Cornelius, NC (US)

( * ) Notice: Subject to any disclaimer, the term of this patent is extended or adjusted under 35 U.S.C. 154(b) by 0 days.

(21) Appl. No.: 16/777,407

(22) Filed: Jan. 30, 2020

(65) Prior Publication Data

US 2020/0237051 A1 Jul. 30, 2020

Related U.S. Application Data

(60) Provisional application No. 62/798,769, filed on Jan. 30, 2019.

(51) Int. Cl.
*A43C 11/00* (2006.01)
*A43C 11/14* (2006.01)

(52) U.S. Cl.
CPC ..... *A43C 11/006* (2013.01); *A43C 11/008* (2013.01); *A43C 11/14* (2013.01)

(58) Field of Classification Search
CPC ..... A43B 3/0052; A43B 23/28; A43C 1/003; A43C 1/006; A43C 11/008; A43C 11/14; A43C 11/24
USPC ..... 36/105
See application file for complete search history.

(56) References Cited

U.S. PATENT DOCUMENTS 3,327,410 A * 6/1967 Park, Sr. ..... A43B 5/00 36/89
4,547,981 A * 10/1985 Thais ..... A43C 11/1493 36/89
4,811,498 A * 3/1989 Barret ..... A43B 7/1495 36/117.2
4,845,864 A 7/1989 Corliss
5,042,119 A 8/1991 Williams
5,323,549 A * 6/1994 Segel ..... A43B 7/1495 36/140
7,685,747 B1 * 3/2010 Gasparovic ..... A43B 11/00 36/102
7,841,106 B2 11/2010 Farys
9,907,363 B2 * 3/2018 Smith ..... A43C 11/1493
10,716,356 B2 * 7/2020 Bell ..... A43B 3/06
2014/0259781 A1 * 9/2014 Sakai ..... A43B 23/16 36/102

(Continued)

OTHER PUBLICATIONS

"Twisted Women's Trooper Rear Buckle Military Boot", https://www.amazon.com/Twisted-Womens-Trooper-Buckle-Military/dp/B00MMPJ6O2/ref=cm_cr_arp_d_product_top?ie=UTF8.

*Primary Examiner* — Sharon M Prange

(57) ABSTRACT

An easy removal prevention footwear apparatus includes a footwear, a medial opening, a lateral opening, a first elastic band, a second elastic band, and a fastener. The footwear delineates a general configuration of a shoe. A first proximal end of the first elastic band is internally connected to the footwear. A second proximal end of the second elastic band is internally connected to the footwear, opposite of the first proximal end. The medial opening and the lateral opening traverse into a counter section of the footwear. A first distal end of the first elastic band slidably traverses through the lateral opening. A second distal end of the second elastic band slidably traverses through the medial opening. The first distal end and the second distal end are tensionably attached to each other by the fastener thus configuring two different securing loops between the footwear and the user's foot.

4 Claims, 6 Drawing Sheets

(56) References Cited

U.S. PATENT DOCUMENTS

| | | | | |
|---|---|---|---|---|
| 2017/0135444 | A1 | 5/2017 | Vincent | |
| 2019/0133255 | A1* | 5/2019 | Sullivan | A43C 11/004 |
| 2019/0223555 | A1* | 7/2019 | Iannuzzi | A43B 1/0027 |

* cited by examiner

EASY REMOVAL PREVENTION FOOTWEAR APPARATUS

The current application claims a priority to the U.S. Provisional Patent application Ser. No. 62/798,769 filed on Jan. 30, 2019.

FIELD OF THE INVENTION

The present invention relates generally to footwear. More specifically, the present invention is a footwear with integrated rear fasteners to prevent the wearer from easily removing or kicking off the footwear.

BACKGROUND OF THE INVENTION

Currently, in present society, some individuals often need to put shoes and such on the feet of other individuals who are incapable of doing so themselves. However, often times, while at rest or not in motion, these individuals can try to remove the shoes off of their feet in a wide variety of ways with a common way being the kicking off of the shoes by applying a leveraging force against the rear of the heel or the achilleas tendon of the footwear with the toe of the opposite foot. Common fasteners on current footwear do not prevent this in part due to the location of these fasteners being in the top-front surface and across the metatarsal of the foot. Instead, the issue can be prevented or resolved by including an additional fastener which can constrict the user's foot within the shoes so as to make it difficult for the user to simply kick-off their own shoes or remove the shoes without the assistance of another.

An objective of the present invention is to provide users with an apparatus that is a footwear with efficient means of preventing removal of the footwear. The present invention intends to provide users with a footwear with common features of footwears while supplying a solution to resolve the issues discussed previously. The present invention intends to provide users with a footwear with a pair of elastic bands within the footwear across the fibula and the tibia of the wearer's foot that restricts wearer's effort to simply pull off the footwear without the assistance of a user. The present invention intends to provide users with a footwear that contains a fastening mechanism to secure the pair of elastic bands to each other about the wearer's foot such the wearer can't remove the footwear without assistance of the user. The present invention intends to provide users with a footwear which contains a flap to conceal the fastening mechanism.

SUMMARY OF THE INVENTION

The present invention is an easy removal prevention footwear apparatus. The present invention primarily consists a footwear. The footwear primarily contains a plurality of existing features that are common and/or useful to a footwear. The footwear also contains a pair of elastic bands within the top-front section of the footwear across or along the anterior surface of the fibula of the wearer's foot. Free ends of the pair of elastic bands emerge slightly from the rear of the footwear and can be fastened to each other in order to secure the wearer's foot within the footwear.

DETAIL DESCRIPTIONS OF THE INVENTION

All illustrations of the drawings are for the purpose of describing selected versions of the present invention and are not intended to limit the scope of the present invention.

The present invention is an easy removal prevention footwear apparatus so that the users can not remove their shoes from their feet by kicking off of the shoes or applying a leveraging force against the rear of the footwear with the toe of the opposite foot. The present invention is extremely important to parents with younger kids as they tend to take of their shoes with aforementioned methods. In other words, children and toddlers are not able to take of their shoes by themselves due to the configuration of the present invention.

Figure 1:
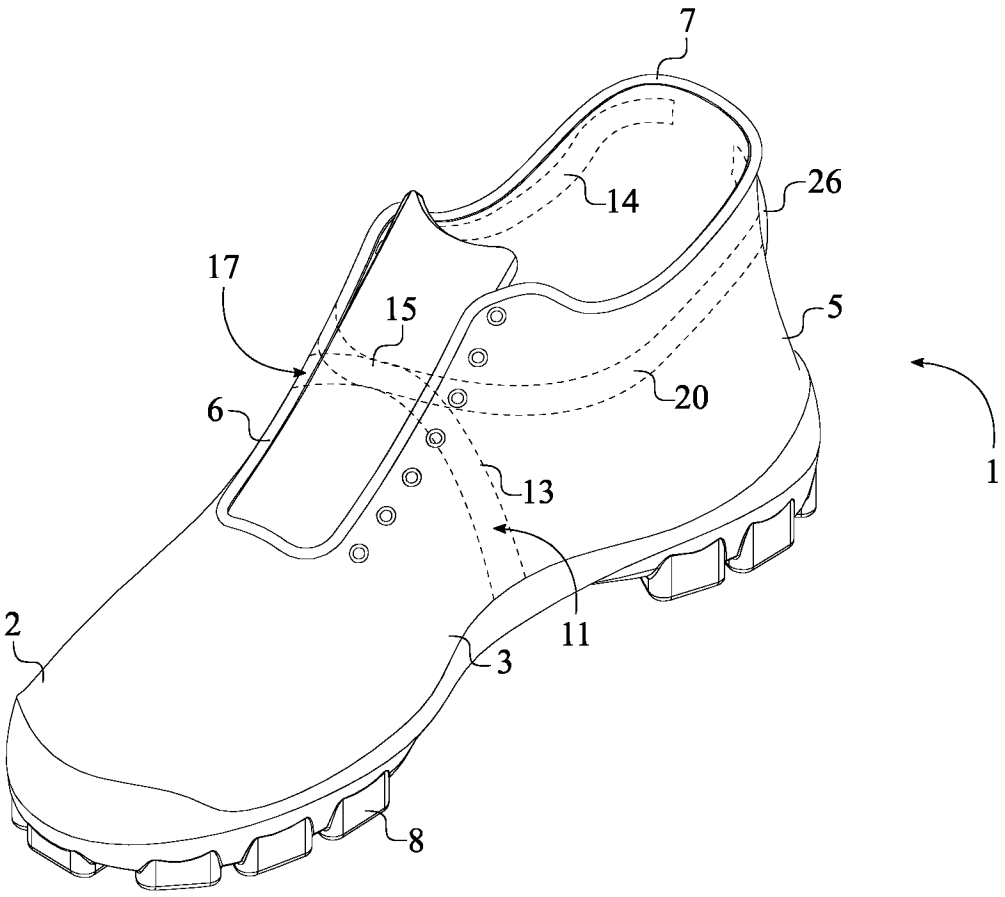
FIG. 1 is a front perspective view of the present invention, showing the medial quarter of the present invention and the dash lines illustrate the internal positioning of the first elastic band and the second elastic band.
Figure 2:
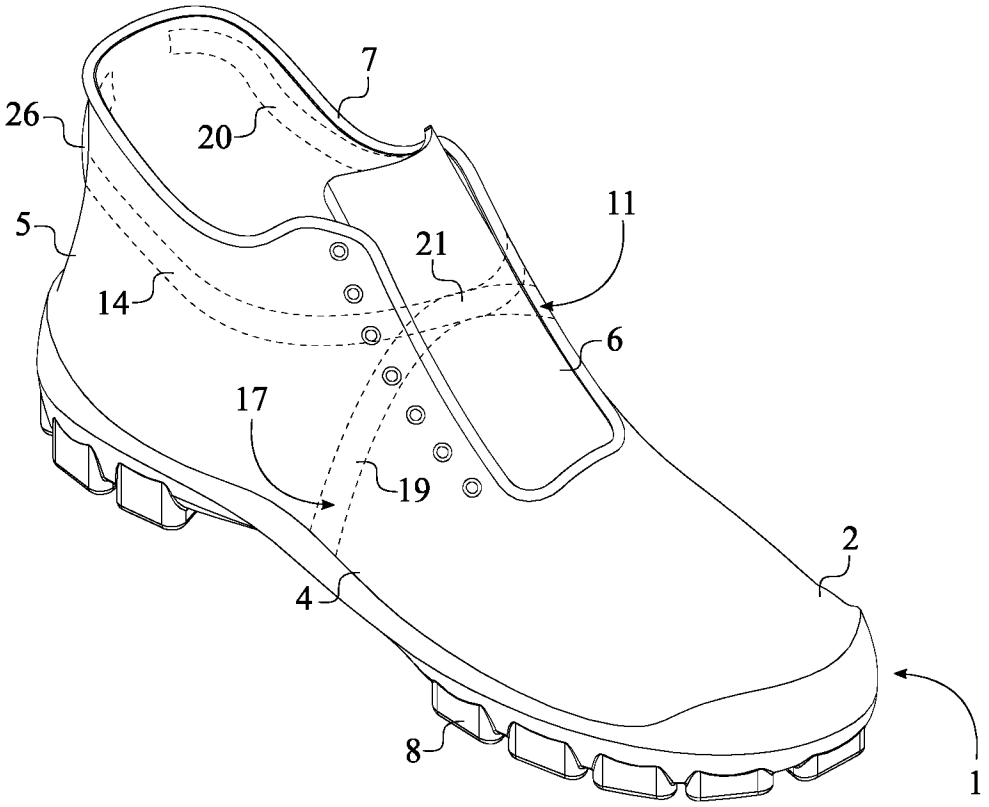
FIG. 2 is a front perspective view of the present invention, showing the lateral quarter of the present invention and the dash lines illustrate the internal positioning of the first elastic band and the second elastic band.
Figure 3:
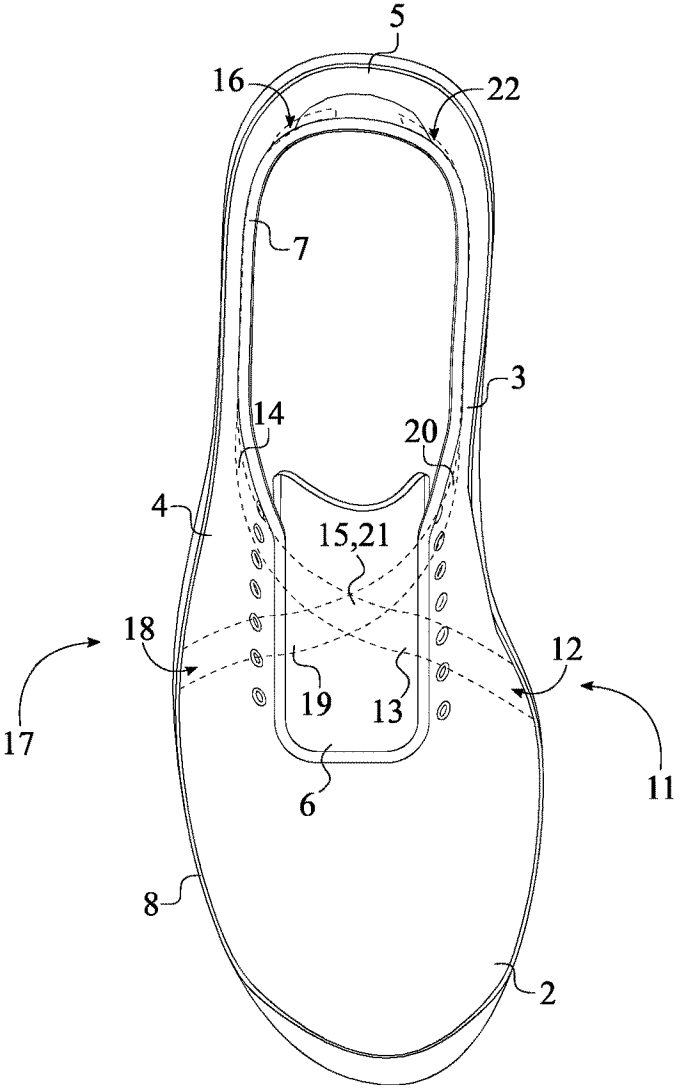
FIG. 3 is a top view of the present invention, wherein the dash lines illustrate the internal positioning of the first elastic band and the second elastic band.

The present invention comprises a footwear 1, a medial opening 9, a lateral opening 10, a first elastic band 11, a second elastic band 17, and a fastener 23 as shown in FIG. 1-3. The footwear 1 is similar to existing close toe shoe and comprises a toe section 2, a medial quarter 3, a lateral quarter 4, a counter section 5, a vamp 6, a topline 7, and a sole 8 as shown in FIG. 1-3. In reference to general configuration, a first proximal end 12 of the first elastic band 11 is internally connected to the footwear 1 so that the first elastic band 11 can tensionably strap around the user's foot and ankle. A second proximal end 18 of the second elastic band 17 is internally connected to the footwear 1, opposite of the first proximal end 12, so that the second elastic band 17 can tensionably strap around the user's foot and ankle. Collectively, the first elastic band 11 and the second elastic band 17 are able to secure the footwear 1 to the user's foot and the user's ankle thus completing two different securing loops with the first elastic band 11 and the second elastic band 17. The medial opening 9 and the lateral opening 10 traverse into the counter section 5 and linearly offset from one another so that the first elastic band 11 the second elastic band 17 can individually traverse through the footwear 1. More specifically, a first distal end 16 of the first elastic band 11 slidably traverses through the lateral opening 10 while a second distal end 22 of the second elastic band 17 slidably traverses through the medial opening 9. The first distal end 16 and the second distal end 22 are tensionably attached to each other by the fastener 23 so that the first elastic band 11 and the second elastic band 17 can internally secures the footwear 1 to the user's foot and the user's ankle.

It is preferred that the footwear 1 contain a plurality of features common to footwear. The plurality of features can include, but is not limited to, shoelaces, eyelets, logos and/or trademarks, illustrations, graphics, aesthetic shoelaces, non-slip features, illumination features, activated sound features, retractable wheels, other similarly related features found on footwear industry, and/or any combination of the previously mentioned items. In reference to FIG. 1-3, the toe section 2, the medial quarter 3, the lateral quarter 4, the counter section 5, and the vamp 6 delineate an upper section of the footwear 1 that positioned atop the sole 8. More specifically, the toe section 2 and the counter section 5 are positioned opposite of each other thus respectively delineating the front end and the rear end of the footwear 1. The toe section 2 and the counter section 5 are connected onto the sole 8 so that the user's foot can be placed within the toe section 2 and the counter section 5. The medial quarter 3 and the lateral quarter 4 are extended from the toe section 2 to the counter section 5 and connected to the sole 8, the toe section 2, and the counter section 5. As a result, the medial quarter 3 covers the medial side of the user's foot and the lateral quarter 4 covers the lateral side of the user's foot. The vamp 6 and the sole 8 being oppositely positioned of each other as the vamp 6 is tensionably connected to the toe section 2, the medial quarter 3, and the lateral quarter 4. The vamp 6 encloses the upper dorsal side of the user's foot from the toe section 2 to the topline 7. The topline 7 defines parameters of an opening within the footwear 1 that the user's foot can be inserted through. The topline 7 is oppositely positioned to the sole 8 and terminally delineated by the free ends of the vamp 6, the medial quarter 3, the lateral quarter 4, and the counter section 5.

The first elastic band 11 and the second elastic band 17 are elongated bodies that are internally positioned within the footwear 1 or slidably positioned within the upper section of the footwear 1. In reference to FIG. 1-3, the first proximal end 12 is terminally connected to the sole 8 and positioned adjacent to the toe section 2 and the medial quarter 3. As a result, the first proximal end 12 defines the connection point between the first elastic band 11 and the medial side of footwear 1. The second proximal end 18 is terminally connected to the sole 8 and positioned adjacent to the toe section 2 and the lateral quarter 4. As a result, the second proximal end 18 defines the connection point between the second elastic band 17 and the lateral side of footwear 1. The first distal end 16 and the second distal end 22 are externally positioned to the counter section 5 as the first elastic band 11 and the second elastic band 17 traverse out of the counter section 5. More specifically, the first distal end 16 slidably traverses through the lateral opening 10 that is positioned adjacent to the lateral quarter 4 and the topline 7. The second distal end 22 slidably traverses through the medial opening 9 that is positioned adjacent to the medial quarter 3 and the topline 7. In order words, the first elastic band 11 is internally connected adjacent to the medial quarter 3 and cross over to the lateral quarter 4 before reaching the lateral opening 10. The second elastic band 17 internally connected adjacent to the lateral quarter 4 and cross over to the medial quarter 3 before reaching the medial opening 9. As a result of the crisscross orientation of the first elastic band 11 and the second elastic band 17, the footwear 1 can be internally secured to the user's foot and ankle with the two different securing loops.

In reference to FIG. 1-3, the first elastic band 11 further comprises a first dorsal section 13, a first ankle section 14, and a first cross section 15. The second elastic band 17 further comprises a second dorsal section 19, a second ankle section 20, and a second cross section 21. Three different sections for the first elastic band 11 and the second elastic band 17 delineate the two different securing loops with respect to the user's foot and the user's ankle via the first elastic band 11 and the second elastic band 17. The first dorsal section 13 is extended from the first proximal end 12 to the first cross section 15. The second dorsal section 19 is extended from the second proximal end 18 to the second cross section 21. More specifically, the first dorsal section 13 and the second dorsal section 19 are laterally looped around the transverse arch of the user's foot thus forming a first securing point as the first dorsal section 13 is positioned across the medial quarter 3, and the second dorsal section 19 is positioned across the lateral quarter 4. The first cross section 15 and the second cross section 21 are positioned adjacent to each other and adjacent to the vamp 6 so that the first elastic band 11 and the second elastic band 17 can cross over each other. Collectively, the first cross section 15 and the second cross section 21 then complete the first securing point as the transverse arch of the user's foot is completely looped by the first dorsal section 13, the second dorsal section 19, the first cross section 15, and the second cross section 21.

Simultaneously, the first cross section 15 and the second cross section 21 also form a second securing point as the first ankle section 14 is extended from the first cross section 15 to the first distal end 16, and the second ankle section 20 is extended from the second cross section 21 to the second distal end 22. Furthermore, the first ankle section 14 is positioned along the lateral quarter 4 and the second ankle section 20 is positioned along the medial quarter 3 so that the user's ankle can be looped via the first elastic band 11 and the second elastic band 17. Once the first distal end 16 and the second distal end 22 are tensionably attached to each other by the fastener 23, the user's ankle can be completely looped by the first cross section 15, the second cross section 21, the first ankle section 14, and the second ankle section 20 thus completing the second securing point.

The fastener 23 can be any types of quick fasteners such as magnetic fasteners, button fasteners, male and female fasteners, mechanical fasteners, or any other type of fasteners that can be incorporated into footwear. In reference to FIG. 4-6, the fastener 23 comprises a first interlocking fastener 24 and a second interlocking fastener 25. The first interlocking fastener 24 is adjustably connected to the first distal end 16. The second interlocking fastener 25 is adjustably connected to the second distal end 22. Resultantly, the first interlocking fastener 24 and the second interlocking fastener 25 can be engaged to secure the footwear 1 or disengaged to remove the footwear 1. Preferably, the first interlocking fastener 24 and the second interlocking fastener 25 are child-proof fasteners so that the engagement and disengagement of the fastener 23 cannot be conducted by children or toddlers. The adjustable connections of the first interlocking fastener 24 and the first distal end 16 and the second interlocking fastener 25 and the second distal end 22 enable slight tension adjustments so that the first securing point and the second securing point can be properly adjusted with respect to the user's foot and user's ankle.

In some embodiment, the connection between the first interlocking fastener 24 and the first distal end 16 and the connection between the second interlocking fastener 25 and the second distal end 22 can be fixed connections which is not adjustable.

Figure 4:
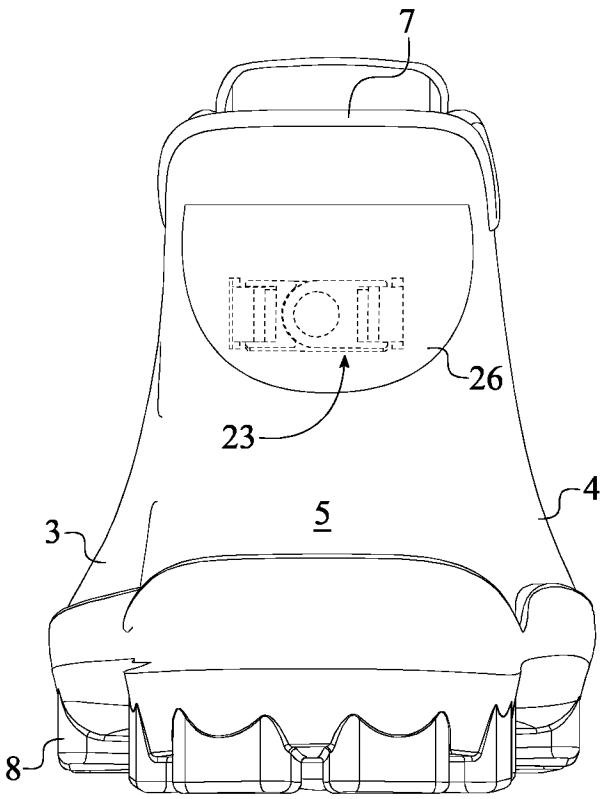
FIG. 4 is a rear view of the present invention, wherein the dash lines illustrate the fastener that is hidden behind the flap.
Figure 5:
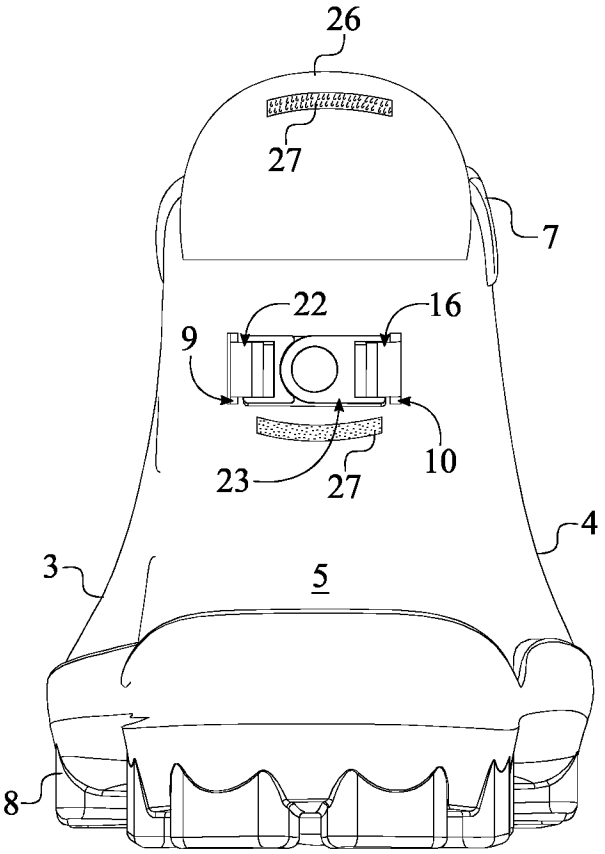
FIG. 5 is a rear view of the present invention, wherein the engaged configuration of the fastener is visible as the flap is opened.
Figure 6:
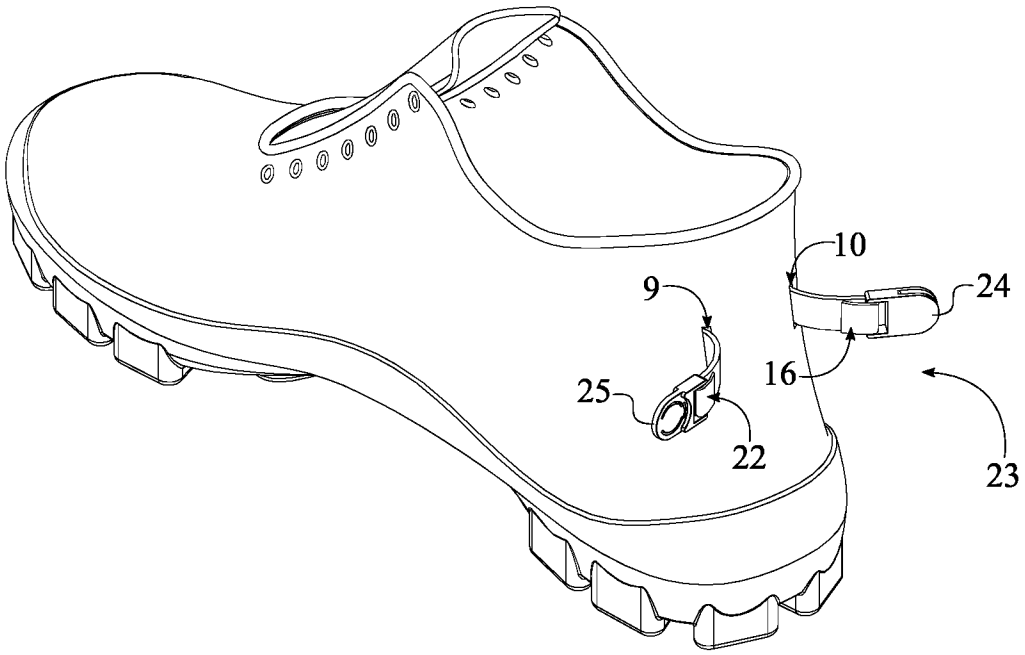
FIG. 6 is a rear perspective view of the present invention, showing the disengaged configuration of the fastener.

The present invention further comprises a flap 26 as shown in FIG. 4-5. The flap 26 is a flexible body and terminally connected to the counter section 5, adjacent to the topline 7, so that the fastener 23 can be enclosed by the flap 26. More specifically, when the user need to interact with the fastener 23, the flap 26 is bent upward thus exposing the fastener 23. When the present invention is worn by the user, the fastener 23 is covered by the flap 26 to display a clean and esthetically pleasing look about the counter section 5. Furthermore, a fastening mechanism 27 of the present invention is integrated in between the flap 26 and the counter section 5 to maintain a stationary position for the flap 26. Resultantly, the fastening mechanism 27 is able to keep the flap 26 adhered to the counter section 5 thus covering the fastener 23. The fastening mechanism 27 is preferably a hook-and-loop fastener; however, the fastening mechanism 27 can be any other types of easily detachable fasteners such as magnetic fasteners, snap fasteners, and zippers.

In some embodiment the flap 26 can be terminally connected to the counter section 5, adjacent to the lateral quarter 4 so that the flap 26 can be opened about the medial quarter 3. In some embodiment the flap 26 can be terminally connected to the counter section 5, adjacent to the medial quarter 3 so that the flap 26 can be opened about the lateral quarter 4.

Although the invention has been explained in relation to its preferred embodiment, it is to be understood that many other possible modifications and variations can be made without departing from the spirit and scope of the invention as hereinafter claimed.

What is claimed is:

1. An easy removal prevention footwear apparatus comprising:

a footwear;

a medial opening;

a lateral opening;

a first elastic band;

a second elastic band;

a fastener;

a flap;

the footwear comprising a toe section, a medial quarter, a lateral quarter, a counter section, a vamp, a topline, and a sole;

the first elastic band and the second elastic band each being an elongated band of constant width;

a first proximal end of the first elastic band being internally connected to the footwear;

a second proximal end of the second elastic band being internally connected to the footwear, opposite of the first proximal end;

the medial opening and the lateral opening traversing into the counter section;

a first distal end of the first elastic band slidably traversing through the lateral opening;

a second distal end of the second elastic band slidably traversing through the medial opening;

the first distal end and the second distal end being tensionably attached to each other by the fastener;

the first elastic band further comprising a first dorsal section, a first ankle section, and a first cross section;

the second elastic band further comprising a second dorsal section, a second ankle section, and a second cross section;

the first dorsal section being extended from the first proximal end to the first cross section;

the first ankle section being extended from the first cross section to the first distal end;

the second dorsal section being extended from the second proximal end to the second cross section;

the second ankle section being extended from the second cross section to the second distal end;

the first dorsal section being positioned across the medial quarter;

the second dorsal section being positioned across the lateral quarter;

the first ankle section being positioned along the lateral quarter;

the second ankle section being positioned along the medial quarter;

the fastener comprising a first interlocking fastener and a second interlocking fastener;

the first interlocking fastener being adjustably connected to the first distal end;

the second interlocking fastener being adjustably connected to the second distal end;

the first interlocking fastener and the second interlocking fastener being engageable with each other;

the first proximal end being terminally connected to the sole;

the first proximal end being positioned adjacent to the toe section and the medial quarter;

the second proximal end being terminally connected to the sole;

the second proximal end being positioned adjacent to the toe section and the lateral quarter;

the first distal end being externally positioned to the counter section;

the second distal end being externally positioned to the counter section;

the medial opening being positioned adjacent to the medial quarter and the topline;

the lateral opening being positioned adjacent to the lateral quarter and the topline;

the flap being terminally connected to the counter section, adjacent to the topline; and the fastener being perimetrically enclosed by the flap.

2. The easy removal prevention footwear apparatus as claimed in claim 1 comprising:

the toe section and the counter section being positioned opposite of each other;

the toe section and the counter section being connected onto the sole;

the medial quarter and the lateral quarter being extended from the toe section to the counter section;

the medial quarter and the lateral quarter being connected to the sole, the toe section, and the counter section;

the vamp and the sole being oppositely positioned of each other;

the vamp being tensionably connected to the toe section, the medial quarter, and the lateral quarter;

the topline being terminally delineated by the vamp, the medial quarter, the lateral quarter, and the counter section; and the topline and the sole being oppositely positioned of each other.

3. The easy removal prevention footwear apparatus as claimed in claim 1 comprising:

the first cross section and the second cross section being positioned adjacent to each other; and the first cross section and the second cross section being positioned adjacent to the vamp.

4. The easy removal prevention footwear apparatus as claimed in claim 1 comprising:

a fastening mechanism; and the fastening mechanism being integrated in between the flap and the counter section.

* * * * *